US006508371B2

(12) United States Patent
Miyazawa

(10) Patent No.: US 6,508,371 B2
(45) Date of Patent: Jan. 21, 2003

(54) JIB CRANE

(75) Inventor: Isao Miyazawa, Saitama (JP)

(73) Assignee: Ishi Kawajima-Harima Jukogyo Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/088,099

(22) PCT Filed: Jul. 27, 2001

(86) PCT No.: PCT/JP01/06476

§ 371 (c)(1),
(2), (4) Date: Mar. 22, 2002

(87) PCT Pub. No.: WO02/12110

PCT Pub. Date: Feb. 14, 2002

(65) Prior Publication Data

US 2002/0170871 A1 Nov. 21, 2002

(30) Foreign Application Priority Data

Aug. 9, 2000 (JP) ..... 2000-241341
Aug. 9, 2000 (JP) ..... 2000-241342

(51) Int. Cl.[7] ..... B66C 23/82

(52) U.S. Cl. ..... 212/262; 212/239; 52/116; 52/690

(58) Field of Search ..... 212/239, 240, 212/262; 52/116, 690, 691, 693

(56) References Cited

U.S. PATENT DOCUMENTS 3,072,265 A * 1/1963 Nickles ..... 212/59
3,339,707 A * 9/1967 Ludwig ..... 198/77
5,232,327 A * 8/1993 Steckel ..... 414/141.4

FOREIGN PATENT DOCUMENTS

| | | |
|---|---|---|
| JP | 56-82792 | 7/1981 |
| JP | 1-317997 | 12/1989 |
| JP | 4-235895 | 8/1992 |
| JP | 11-43288 | 2/1999 |
| JP | 2000-177983 | 6/2000 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A jib is supported for its luffing movement by a luffing rope mounted to a longitudinally intermediate portion of the jib. The jib has a truss structure with upper and lower beam members respectively overhanging upward and downward of load action line which connects a lifting point with a support pin. Assuming that, when the burden of maximum load is lifted up, P is a load applied on the load action line from the tip of the jib; H is a width between upper and lower portions of the jib at a mounting point of the luffing rope; Eu and El are overhang eccentric lengths of the upper and lower beam members at the mounting point of the luffing rope with respect to the load action line, respectively; and Au and Al are cross-sectional areas of the upper and lower beam members, respectively, then cross-sectional areas Au and Al of the upper and lower beam members are determined depending upon overhang eccentric lengths Eu and El of the upper and lower beam members to satisfy $$P \times \frac{El}{H \cdot Au} > P \times \frac{Eu}{H \cdot Al},$$

so that an upper portion of the jib is recurved toward a crane body when the burden of maximum load is lifted up.

9 Claims, 7 Drawing Sheets

PRIOR ART FIG. 1

JIB CRANE

TECHNICAL FIELD

The present invention relates to a jib crane and, more specifically, to a jib crane which prevents a burden from being unexpectedly displaced upon dynamic lift off or laying-down of the burden.

BACKGROUND ART

FIG. 1 is a side view showing a jib crane in which reference numeral 1 denotes a traveling or stationary type (shown in the figure is the traveling type) support base; and 2, a revolving frame revolvably mounted on the support base 1 via a revolving table 3. The support base 1 and revolving frame 2 constitute a crane body 4.

The revolving frame 2 in the crane body 4 has a front portion to which a jib 5 is pivoted for its luffing movement through a support pin 6. Mounted on the revolving frame 2 is a luffing winch 7 which reels or unreels a luffing rope 8 which in turn is reeved on a sheave 10*a* at a top of an A-frame 9 on the revolving frame 2, on a sheave 10*b* at a tip of the jib 5 and again on the sheave 10*a* and is fixed to the revolving frame 2. The luffing winch 7 reels or unreels the luffing rope 8 to cause luffing motion of the jib 5.

Also mounted on the revolving frame 2 is a hoisting winch 11 which reels or unreels a lifting rope 12 which in turn is reeved on a sheave 13 at the top of the A-frame 9, between the sheave 13 and a sheave 14 (lifting point) at the tip of the jib 5 and between the sheave 14 and a sheave 16 of a hook block 15. The lifting rope 12 is wound at its end around a luffing drum (not shown), which cooperates with the luffing winch 7, in a direction opposite to that of the latter. Driving the hoisting winch 11 causes a burden 17 suspended from the hook block 15 to be lifted up or down.

The lifting rope 12 is unreeled by the luffing drum when the luffing rope 8 is reeled by the luffing winch 7 to raise the jib 5, and is reeled by the luffing drum when the raised jib 5 is lowered into substantially horizontal, thereby providing level luffing of the burden 17 without changing its height. Number of times of reeving the lifting rope 12 between the sheave at the lifting point 14 and the sheave 13 at the upper end of the A-frame 9 is, for example, doubled against number of times of reeving the lifting rope 12 between the sheave at the lifting point 14 and the sheave 16 of the hook block 15, which prevents load applied by the lifting rope 12 from acting as resistance to the luffing motion of the jib 5 to facilitate the luffing motion of the jib 5 and enable smooth level luffing of the burden 17.

FIG. 1 shows the jib 5 of the jib crane in its most raised position (with a luffing angle θ of the jib 5 to horizontal plane being maximum). In this state, the jib crane can lift up the burden 17 of maximum load (or load rating). When the jib 5 is lowered to substantially horizontal as shown in FIG. 3, load of the burden 17 liftable is decreased in terms of increased moment load.

FIG. 2 shows a typically known A-frame 9 mounted on the revolving frame 2 and comprising a front frame 9*a* with rigidity and a rear frame 9*b* with a smaller cross-sectional area and acting as a tension bar. Also in FIG. 1, the front frame 9*a* is a structure with rigidity and the rear frame 9*b* is a tension bar with a smaller cross-sectional area.

In the jib crane of FIGS. 1 and 2 and when the jib 5 is substantially horizontal, the front and rear frames 9*a* and 9*b* of the A-frame 9 are subjected to compression and tensile loads, respectively. When the jib 5 is raised to lift up the burden 17 of maximum load (or load rating), both the front and rear frames 9*a* and 9*b* are subjected to large tensile load T.

The above-mentioned conventional jib crane generally has a following problem. Shown in FIG. 1 by the solid lines is the jib crane with the jib 5 being raised without the burden 17. When the burden 17 of maximum load is lifted up from this state, the crane body 4 and jib 5 are deflected and tilted forward as indicated by chain double-dashed lines due to the heavy load. In other words, the tip of the jib 5 is bent downward and the support base 1 of the crane body 4 is deflected forward and the revolving table 3 is deflected forward.

When the burden of maximum load is lifted up, extremely large tensile load T acts on both the front and rear frames 9*a* and 9*b* of the A-frame 9 as shown in FIG. 2; the rear frame 9*b* of the conventional A-frame 9, which is used as a tension bar and has a smaller cross-sectional area, is lengthened by the tensile load T, resulting in deflection and forward tilting of the entire A-frame 9 as indicated by chain double-dashed lines.

The above-mentioned forward deflections of the crane body 4, jib 5 and A-frame 9 are greatest when the burden 17 of maximum load is lifted up with the jib 5 being raised. When the jib 5 approaches horizontal, a forward displacement distance of the tip of the jib 5 is decreased in connection with reduced load of the burden 17 liftable and the luffing angle θ of the jib 5 from horizontal plane.

As mentioned above, when the burden 17 of maximum load is lifted up by the jib crane, the crane body 4, jib 5 and A-frame 9 are deflected and tilted forward so that the lifting point 14 at the tip of the jib 5 is displaced forward by a forward displacement distance +X as shown in FIG. 1. This causes the burden 17 to be displaced forward, by the forward displacement distance +X, from a position originally expected.

As a result, in the jib crane of FIG. 1 and upon dynamic lift off of the burden 17 of maximum load on the ground with the hook block 15 being aligned to a gravity center of the burden 17, the crane body 4, jib 5 and A-frame 9 are tilted forward as shown by the chain double-dashed lines as mentioned above and the burden 17 is thrown forward by the forward displacement distance +X, resulting in a problem of the burden 17 being swung back and forth.

When the burden 17 of maximum load lifted by the jib crane as indicated by the chain double-dashed lines in FIG. 1 is laid down into a predetermined position, the load of the burden 17 is relieved the very moment the burden 17 contacts the installation position, which causes the forward tilted crane body 4 to be raised up as shown by the solid lines. As a result, the burden 17 is unexpectedly drawn back by the forward displacement distance +X.

Thus, since the burden 17 is displaced when it is dynamically lifted off the ground or laid down, collision of the burden 17 with any nearby structure or other problems may occur. In a case where the burden 17 such as a steel block is lifted up, moved and positioned for placement on an object to be welded, the steel block is displaced the very moment it is placed on the object to be welded, which results in difficulties in accurately positioning the block and causes a problem of a long time being required for the positioning work.

SUMMARY OF THE INVENTION

An object of the invention is to provide a jib crane wherein cross-sectional areas of upper and lower beam members constituting a jib are determined depending upon overhang eccentric lengths of the upper and lower beam members such that, when a burden of maximum load is lifted up, an upper portion of the jib is recurved toward a crane body and thus a forward displacement distance of a tip of the jib due to forward tilting of the crane body is counterbalanced with a backward displacement distance due to the recurvature of the jib toward the crane body, thereby preventing unexpected displacement of the burden when the burden is dynamically lifted off a ground or laid down by the jib crane.

A further object of the invention is to provide a jib crane wherein cross-sectional areas of front and rear frames constituting an A-frame are determined such that, when a burden of maximum load is lifted up, the front frame is lengthened to displace backward an upper end of the A-frame and thus a forward displacement distance of a tip of the jib due to forward tilting of a crane body is counterbalanced with a backward displacement distance due to the backward deformation of the A-frame, thereby preventing unexpected displacement of the burden when the burden is dynamically lifted off a ground or laid down by the jib crane.

A still further object of the invention is to provide a jib crane wherein determination of cross-sectional areas of upper and lower beam members constituting a jib depending upon overhang eccentric lengths of the upper and lower beam members is carried out concurrently with determination of cross-sectional areas of front and rear frames constituting an A-frame, thereby preventing a tip of the jib from being displaced when a burden of maximum load is lifted up.

BEST MODE FOR CARRYING OUT THE INVENTION

Figure 1:
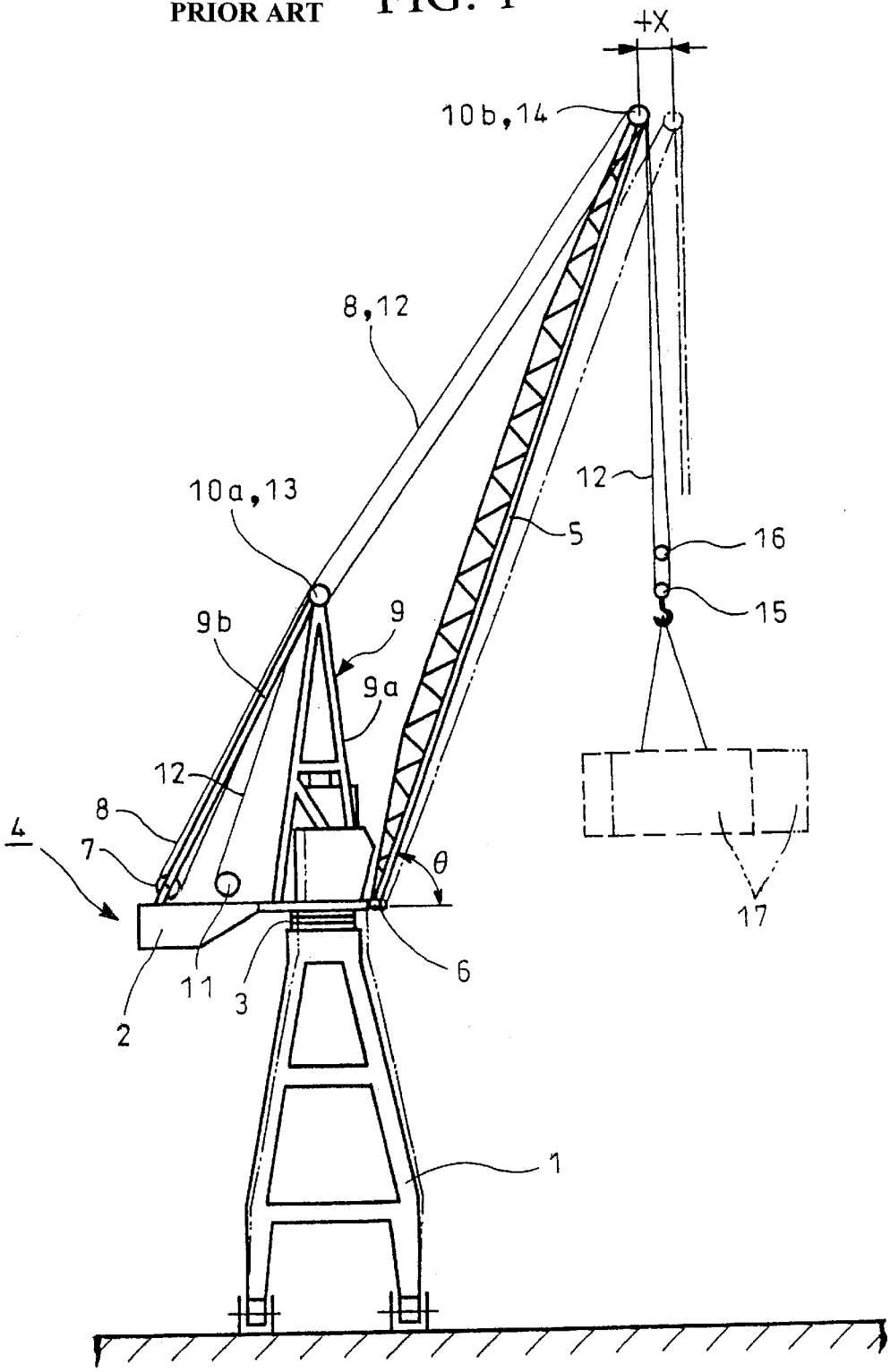
FIG. 1 is a side view showing a conventional jib crane.
Figure 2:
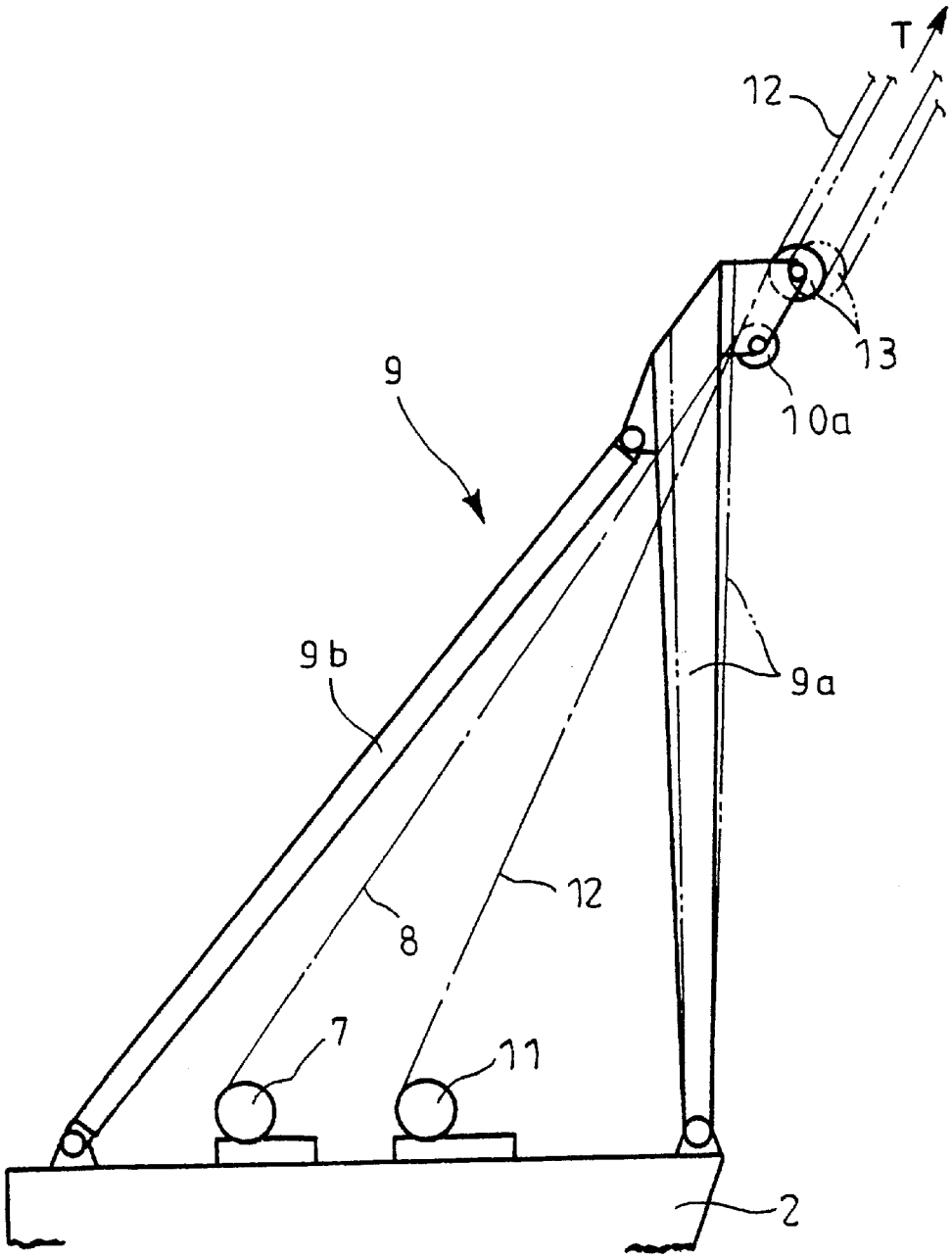
FIG. 2 PRIOR ART
FIG. 2 is a side view of an A-frame in the jib crane of FIG. 1.

Embodiments of the invention will be described with reference to the drawings. FIGS. 3 to 6 show an embodiment of a jib crane according to the invention in which parts identical with those shown in FIGS. 1 and 2 are denoted by the same reference numerals and descriptions thereon are omitted. Detailedly described are only parts that characterize the invention.

Figure 3:
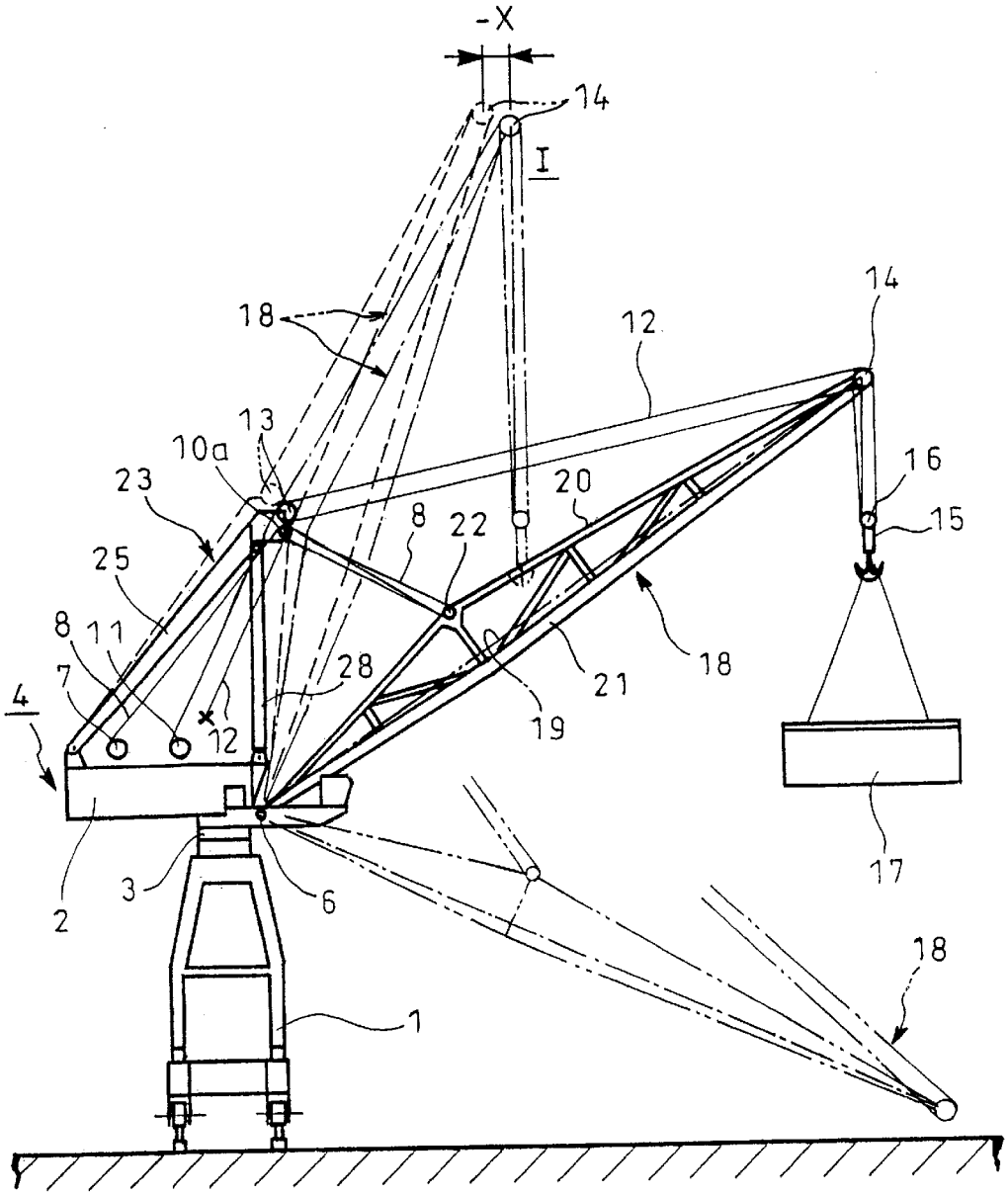
FIG. 3 is a side view showing an embodiment of a jib crane according to the invention.
Figure 4:
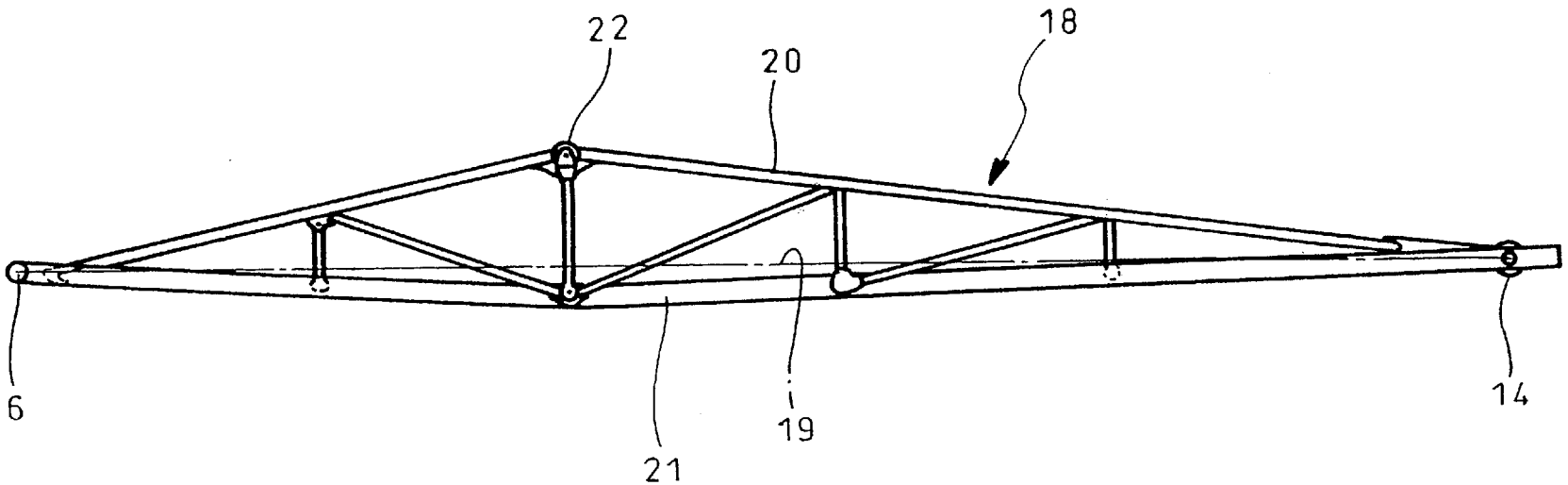
FIG. 4 is a side view of the jib in the jib crane of FIG. 3.
Figure 5:
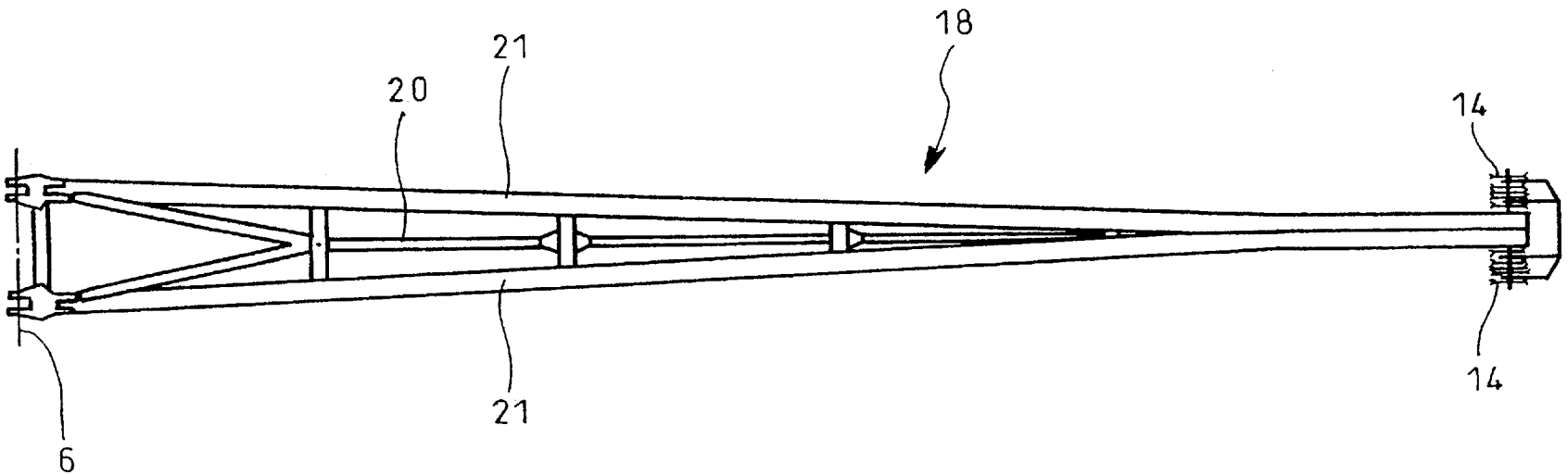
FIG. 5 is a bottom view of the jib of FIG. 4.

A revolving frame 2 in FIG. 3 has a front portion to which a jib 18 constructed as shown in FIGS. 4 and 5 is pivoted for its luffing movement through a support pin 6. Also mounted on the revolving frame 2 backward of the jib 18 is an A-frame 23.

A luffing rope 8 from a luffing winch 7 on the revolving frame 2 and reeved on a sheave 10*a* at an upper end of the A-frame 23 on the revolving frame 2 is further reeved on a sheave 22 (mounting point) arranged at a longitudinally intermediate portion of the jib 18. The jib 18 is raised up or down by the actuation of the luffing winch 7.

The jib 18 has a truss structure with upper and lower beam members 20 and 21 as shown in FIGS. 4 and 5. The upper beam member 20 comprises a single thin pipe which overhangs upward with a larger overhang eccentric length to have a maximum spacing from load action line 19, which connects a lifting point 14 at the top of the jib 18 with the support pin 6, at the mounting point 22 where the sheave for the luffing rope 8 is mounted. The lower beam member 21 comprises two thick pipes which overhang downward with a smaller overhang eccentric length to have a maximum spacing from the load action line 19 at the mounting point 22 of the luffing rope 8.

A lifting rope 12 from a hoisting winch 11 in FIG. 3 is reeved on a sheave 13 at the upper end of the A-frame 23 as well as on a sheave of the lifting point 14 at the tip of the jib 18 so as to lift up or down the burden 17 with a hook block 15. Then, load applied by the burden 17 and acting on the tip of the jib 18 is shared by the upper and lower beam members 20 and 21, and eventually acts on the support pin 6 as if it passes through the load action line 19. Thus, the load on the jib 18 acts substantially along the load action line 19 so that the lifting point 14 at the tip of the jib 18 is not restrained by the lifting rope 12. As a result, only the dead weight of the jib 18 is supported by the luffing rope 8; the jib 18 can be easily raised up or down by reeling or unreeling the luffing rope 8.

Figure 6:
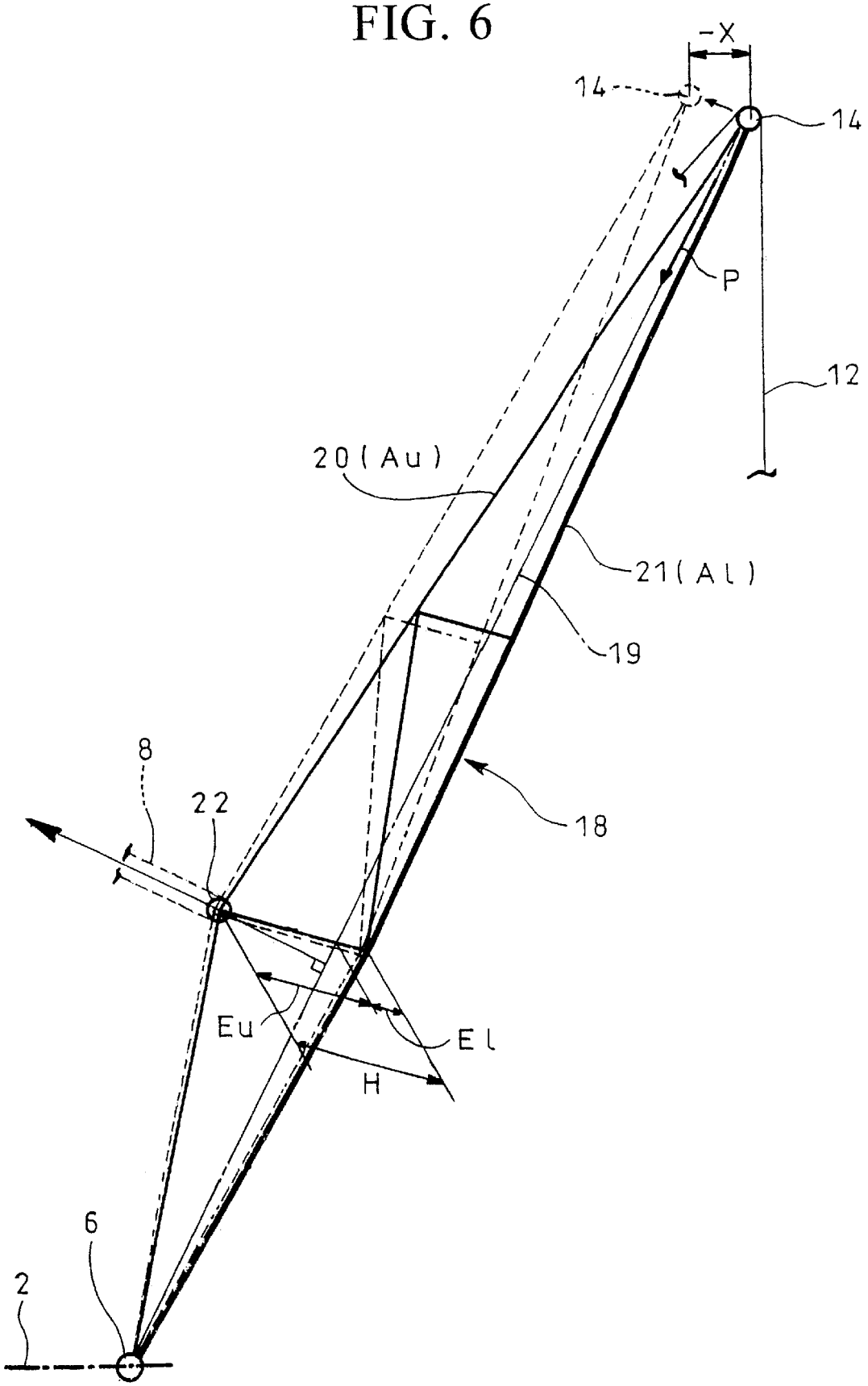
FIG. 6 is a side view showing a support mode and deformation of the jib.

The mounting point 22 of the luffing rope 8 to the jib 18 is, as shown in FIG. 6, at a position where the luffing direction of the rope is substantially perpendicular to the load action line 19 when the jib 18 is raised maximum with the burden of maximum load being lifted up.

In the structure described above, assuming that, as shown in FIG. 6, P is a compression load applied on the load action line 19 of the jib 18 by the burden 17 of maximum load; H is a width between upper and lower portions of the jib 18 at the mounting point 22 of the luffing rope 8; Eu is an overhang eccentric length of the upper beam member 20 at the mounting point 22 of the luffing rope 8 to the load action line 19; El is similarly an overhang eccentric length of the lower beam member 21 to the load action line 19; Au is a cross-sectional area of the upper beam member 20 composed of the single pipe;

and Al is a sum of cross-sectional areas of the lower beam member 21 composed of the two pipes, then stresses σu and σl of the upper and lower beam members 20 and 21 are $$\sigma u = P \times \frac{El}{H \cdot Au} \text{ and } \sigma l = P \times \frac{Eu}{H \cdot Al},$$

respectively.

In the above, if σu=σl, then the jib 18 substantially maintains its state indicated with the solid lines in FIG. 6.

On the other hand, to satisfy σu>σl, or Formula (1) which is:

$$P \times \frac{El}{H \cdot Au} > P \times \frac{Eu}{H \cdot Al}, \tag{1}$$

the cross-sectional areas Au and Al of the upper and lower beam members 20 and 21 are determined depending upon the overhang eccentric lengths Eu and El of the upper and lower beam members 20 and 21, respectively.

That is, as shown in FIGS. 4 to 6, when the overhang eccentric lengths Eu and El of the upper and lower beam members 20 and 21 are set larger and smaller, respectively, to make larger a ratio of the overhang eccentric lengths, then the cross-sectional areas Au and Al of the upper and lower beam members 20 and 21 are set smaller and larger, respectively; when the overhang eccentric length Eu of the upper beam member 20 is made close and similar in dimension to the overhang eccentric length El of the lower beam member 21, then the cross-sectional area Au of the upper beam member 20 is set small relative to the cross-sectional area Al of the lower beam member 21.

Thus, as described above, to set the cross-sectional areas Au and Al of the upper and lower beam members 20 and 21 depending on the overhang eccentric lengths Eu and El of the upper and lower beam members 20 and 21, respectively, for satisfaction of Formula (1) causes the jib 18 to be deformed, when the burden of maximum load is lifted up, such that the upper portion of the jib 18 is recurved about the mounting point 22 of the luffing rope 8 toward the crane body 4 as shown in dotted lines in FIG. 6. As a result, the lifting point 14 at the tip of the jib 18 is horizontally displaced backward by the backward displacement distance −X.

Further, the mounting point 22 of luffing rope 8 to the jib 18 is, as shown in FIG. 6, arranged at a position where the luffing direction of the rope 18 is substantially perpendicular to the load action line 19 when the jib 18 is raised with the burden of maximum load being lifted up. Thus, luffing load for the luffing rope 8 is prevented from affecting deformation of the jib 18.

The jib crane in FIGS. 3 to 6 is operated as follows. Preliminarily obtained in the conventional jib crane shown in FIG. 1 capable of lifting up the burden 17 of maximum load (alternatively load rating) of, for example, 200 t, is the forward displacement distance +X by which the tip of the jib 5 is horizontally displaced forward when the crane body 4 is tilted forward and the jib 5 is deformed with the burden 17 of maximum load being lifted up.

On the other hand, in the jib crane shown in FIG. 3 having maximum load liftable of, for example, 200 t, the overhang eccentric lengths Eu and El of the upper and lower beam members 20 and 21, respectively, and the cross-sectional areas Au and Al of the upper and lower beam members 20 and 21, respectively, in the Formula (1) or $$P\times\frac{El}{H\cdot Au} > P\times\frac{Eu}{H\cdot Al} \qquad (1)$$

are set such that the upper portion of the jib 18 is recurved toward the crane body 4 when the burden 17 of maximum load is lifted up.

Here, in order to set the stress σu at the left-hand side larger than the stress σl at the right-hand side in Formula (1), the overhang eccentric length El is set larger or the overhang eccentric length Eu is set smaller; alternatively, the cross-sectional area Au is set smaller or the cross-sectional area Al is set larger; alternatively, these alternatives are carried out at the same time. As a result, the jib 18 is always deformed and recurved toward the crane body 4 when the burden 17 of maximum load is lifted up, so that the deformation of the jib 18 can be directed in one direction.

Further, with respect to the lifting of the burden 17 of maximum load, the backward displacement distance −X by which the tip of the jib 18 is displaced horizontally backward due to recurvate deformation of the jib 18 toward the crane body 4 is set to be substantially equal in absolute value to the forward displacement distance +X by which the tip of the jib 5 is displaced forward due to forward tilting of the conventional crane body 4. This causes the displacement of the tip of the jib 18 to be cancelled so that the displacement distance of the tip of the jib 18 becomes minimum.

As described above, since the forward and backward displacement distances +X and −X when the burden 17 of maximum load is lifted up are counterbalanced, the displacement of the tip of the jib 18 can be suppressed to minimum also upon lifting of burdens 17 of different magnitudes close to maximum load.

Accordingly, unexpected displacement of the burden 17 is securely prevented when the burden 17 is dynamically lifted off the ground or laid down to a predetermined position by the jib crane.

Then, since the mounting point 22 of the luffing rope 8 to the jib 18 is, as shown in FIG. 6, at the position where the luffing direction of the rope 8 is substantially perpendicular to the load action line 19 when the jib 18 is raised with the burden of maximum load being lifted, luffing load of the luffing rope 8 is prevented from affecting recurvate deformation of the jib 18 so that the jib 18 can be securely deformed.

To confirm the operation of the jib crane in FIG. 3 according to the invention, deformation of the jib crane was simulated based on data of actual cranes. The result was compared with data of the conventional jib crane shown in FIG. 1.

In the jib crane in FIG. 3 according to the invention, a jib revolving radius (or distance from the center of the revolving table 3 to the lifting point 14 at the tip of the jib 18) is 27.5 m; maximum load (or compression load P) of the burden 17 is 200 t; a cross-sectional area Au of the upper beam member 20 is pipe outer diameter 406.6 mm×thickness 7.9 mm=5,000 mm$^2$; a cross-sectional area Al of the lower beam member 21 is pipe outer diameter 812.8 mm×thickness 12 mm×2 pipes=30,416 mm$^2$; an overhang eccentric length Eu of the upper beam member 20 is 4,300 mm; and an overhang eccentric length El of the lower beam member 21 is 1,200 mm.

On the other hand, in the conventional jib crane shown in FIG. 1, a jib revolving radius is 27.5 m; and maximum load of the burden is 200 t.

For each of the jib crane according to the invention and the conventional jib crane, an amount of displacement of the tip of the jib when a burden of load of 200 t was lifted up was obtained, and the results are shown in Table 1. In Table 1, positive (+) and negative (−) signs mean displacements forward and backward of the crane, respectively.

TABLE 1

| | Invention | Conventional |
|---|---|---|
| Amount of displacement of lifting point due to deformation of jib | −169 mm | +188 mm |
| Amount of displacement of lifting point due to deformation of crane body | +204 mm | +204 mm |

In Table 1, according to the jib crane of the invention, the amount of forward displacement of the lifting point due to forward tilting of the crane body is substantially counterbalanced by backward recurvate deformation of the jib 18, leading to a total amount of displacement of only 35 mm. Contrary to this, a total amount of displacement of the lifting point of the conventional jib crane is 392 mm. Ratio of the both is 35/392≈0.089, which means that the jib crane according to the invention can reduce the displacement amount of a burden to about 1/11.2, a very small displacement amount.

As described above, since the forward displacement distance +X of the tip of the jib 5 due to forward tilting of the crane body 4 of the conventional jib crane is counterbalanced by the backward displacement distance −X of the tip of the jib 18 due to recurvate deformation of the jib 18, securely prevented from occurring is the problem of the burden 17 being unexpectedly displaced when the burden 17 is dynamically lifted off the ground or laid down by the jib crane.

Accordingly, accurate positioning of the burden 17 is facilitated to remarkably improve workability in, for example, positioning and welding a steel block. Further, prevention of unexpected displacement of the burden 17 when it is dynamically lifted off the ground or laid down also enhances safety in the work.

Figure 7:
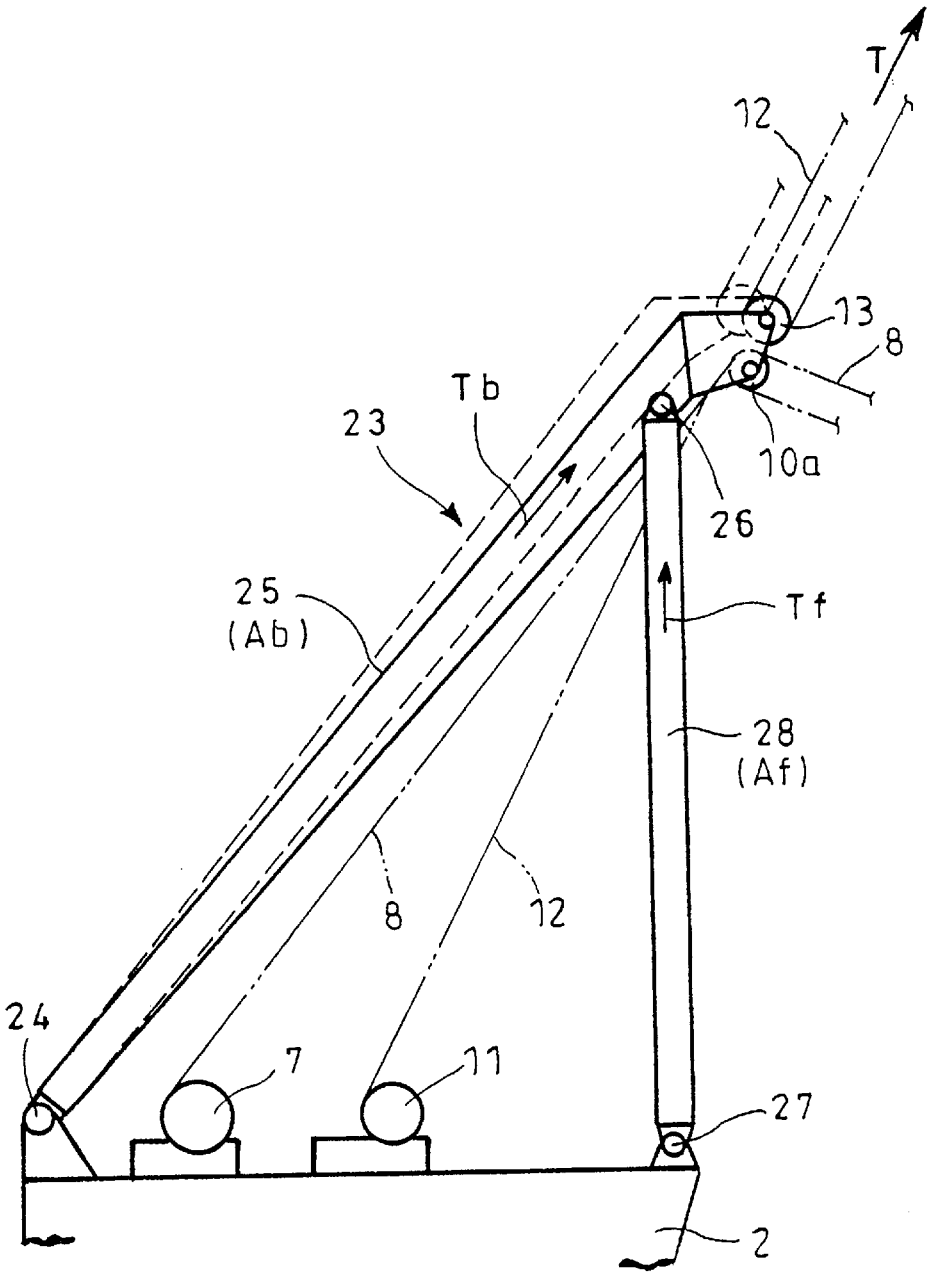
FIG. 7 is a side view of the A-frame in the jib crane of FIG. 3.

FIG. 7 shows a further embodiment of the jib crane according to the invention, illustrating a structure of an A-frame 23 on a revolving frame 2.

The A-frame 23 in FIG. 7 has rear and front frames 25 and 28. The rear frame 25 is equipped at its upper end with a sheave 13 for a lifting rope 12 and is pivoted at its lower end via a pin 24 to the revolving frame 2. The front frame 28 is pivoted at its upper end via a pin 26 to the rear frame 25 at a position adjacent to an upper end of the rear frame 25 and closer to the pin 24 than the sheave 13 (or backward of the sheave) and is pivoted at its lower end via a pin 27 to the revolving frame 2. The rear frame 25 is constituted to have a larger cross-sectional area Ab and a greater rigidity; and the front frame 28 is constituted to have a smaller cross-sectional area Af and a less rigidity.

In the structure described above, when the burden 17 of maximum load is lifted up by the jib crane of FIG. 3 (state I), a large tensile load T acts on the A-frame 23 as shown in FIG. 7. The front frame 28 is subjected to only the tensile stress whereas the rear frame 25 is subjected to the tensile stress as well as stress due to bending moment since, to the rear frame 25, the upper end of the front frame 28 is pivoted via the pin 26 at a position backward of the sheave 13 at the upper end of the rear frame 25.

In the above, assuming that Tf and Tb are tensile forces acting on the front and rear frames 28 and 25, respectively; and Af and Ab are cross-sectional areas of the front and rear frames 28 and 25, respectively, then stresses σf and σb of the front and rear frames 28 and 25 are $$\sigma f = \frac{Tf}{Af} \text{ and } \sigma b = \frac{Tb}{Ab},$$

respectively.

Here, to satisfy the Formula (2) or $$\frac{Tf}{Af} > \frac{Tb}{Ab}, \tag{2}$$

the cross-sectional areas Af and Ab of the front and rear frames 28 and 25 are determined, respectively.

More specifically, as shown in FIG. 7, the cross-sectional areas Ab and Af of the rear and front frames 25 28 are set larger and smaller, respectively.

Such setting of the cross-sectional areas Af and Ab of the front and rear frames 28 and 25 for satisfaction of the Formula (2) causes the front frame 28 to be elongated when the burden of maximum load is lifted up, so that the A-frame 23 is deformed as shown with dotted lines in FIG. 7 such that the upper end of the A-frame 23 is displaced backward.

The deformation and backward displacement of the upper end of the A-frame 23 causes the jib 18 to be pulled backward by the luffing rope 8, which is reeved between the sheave 10*a* and mounting point 22 in FIG. 3, resulting in horizontal backward displacement of the lifting point 14 at the tip of the jib 18 by the backward displacement distance −X as shown with the dotted lines in FIG. 3.

The jib crane with the A-frame 23 shown in FIG. 7 will be worked below.

Preliminarily obtained in the conventional jib crane shown in FIG. 1 capable of lifting up the burden 17 of maximum load (alternatively load rating) of, for example, 200 t, is the forward displacement distance +X by which the tip of the jib 5 is horizontally displaced forward when the crane body 4 is tilted forward and the jib 5 is deformed with the burden 17 of maximum load being lifted up.

On the other hand, in the jib crane of FIG. 3 with the A-frame 23 shown in FIG. 7 and having a maximum load liftable of, for example, 200 t, the cross-sectional areas Af and Ab of the front and rear frames 28 and 25 which satisfy the Formula (2), or $$\frac{Tf}{Af} > \frac{Tb}{Ab} \tag{2}$$

are set such that the upper end of the A-frame 23 is deformed and is displaced backward to displace backward the upper end of the jib 18 when the burden 17 of maximum load is lifted up. More specifically, the cross-sectional areas Ab and Af of the rear and front frames 25 and 28 are set smaller and larger, respectively, to make the stress σf at the left-hand side larger than the stress σb at the right-hand side in Formula (2). As a result, the A-frame 23 is always deformed backward when the burden 17 of maximum load is lifted up, so that the deformation of the A-frame 23 can be directed in one direction.

Further, with respect to the lifting of the burden 17 of maximum load, the backward displacement distance −X by which the tip of the jib 5 is displaced horizontally backward due to recurvate deformation of the A-frame 23 is set to be substantially equal in absolute value to the forward displacement distance +X by which the tip of the jib 5 is displaced forward due to forward tilting of the crane body 4 of the conventional jib crane. This causes the displacement of the tip of the jib 18 to be cancelled so that the displacement distance of the tip of the jib 18 becomes minimum.

As described above, since the forward displacement distance +X of the tip of the jib 5 due to forward tilting of the crane body 4 of the conventional jib crane is counterbalanced with the backward displacement distance −X of the tip of the jib 18 due to recurvate deformation of the jib 18, securely prevented from occurring is the problem of the burden 17 being unexpectedly displaced when the burden 17 is dynamically lifted off the ground or laid down by the jib crane.

Accordingly, accurate positioning of the burden 17 is facilitated to remarkably improve workability in, for example, positioning and welding a steel block. Further, prevention of unexpected displacement of the burden 17 when it is dynamically lifted off the ground or laid down also enhances safety in the work.

Exemplified in the embodiments described above are cases where the structures of the jib 18 and of the A-frame 23 are alternatively adopted. However, determination of the cross-sectional areas Al and Au of the lower and upper beam members 21 and 20 depending upon the overhang eccentric lengths Eu and El of the upper and lower beam members 20 of the jib 18, respectively, as shown in FIGS. 4 to 6 may be carried out concurrently with setting of the cross-sectional areas Af and Ab of the front and rear frames 28 and 25 of the A-frame 23 as shown in FIG. 7. Also in this case, the tip of the jib 18 can be prevented from being displaced when the burden of maximum load is lifted up by the jib crane.

It is to be understood that invention is not limited to the above embodiments and that various changes and modifications may be made without departing from the scope of the invention. For example, it is applicable to various types of jib crane. Shapes and dimensions and the like of the jib and the A-frame are not limited to those shown in the figures.

INDUSTRIAL APPLICABILITY

Forward displacement of a tip of a jib due to forward tilting of a jib crane body is cancelled when a burden of maximum load is lifted up, so that the tip of the jib is prevented from being displaced. Therefore, no unexpected displacement of the burden is caused when it is dynamically lifted off the ground or laid down, which fact is suitable for safe and effective crane work.

What is claimed is:

1. A jib crane characterized in that a jib mounted to a crane body is supported for luffing movement thereof by a luffing rope mounted to a longitudinally intermediate portion of the jib, the jib having a truss structure with upper and lower beam members respectively overhanging upward and downward of load action line which connects a lifting point with a support pin, cross-sectional areas Au and Al of the upper and lower beam members, respectively, being determined depending upon overhang eccentric lengths Eu and El of the upper and lower beam members, respectively, so as to satisfy $$P \times \frac{El}{H \cdot Au} > P \times \frac{Eu}{H \cdot Al}$$

where, when the burden of maximum load is lifted up, P is a load applied on the load action line from the tip of the jib; H is a width between upper and lower portions of the jib at a mounting point of the luffing rope; Eu and El are overhang eccentric lengths of the upper and lower beam members at the mounting point of the luffing rope with respect to the load action line, respectively; and Au and Al are cross-sectional areas of the upper and lower beam members, respectively, whereby an upper portion of the jib is recurved toward the crane body when the burden of maximum load is lifted up.

2. A jib crane according to claim 1 characterized in that a backward displacement distance of the tip of the jib due to recurvature of the jib toward the crane body when the burden of maximum load is lifted up is made equal to a forward displacement distance of the tip of the jib horizontally displaced forward due to forward tilting of the crane body when the burden of maximum load is lifted up.

3. A jib crane according to claim 2 characterized in that the luffing rope is mounted to the jib such that it is substantially perpendicular to the load action line of the jib when the burden of maximum load is lifted up.

4. A jib crane as claimed in claim 2, the backward displacement distance of the tip of the jib horizontally displaced backward due to the recurvature of the jib toward the crane body as well as due to the backward displacement of the upper end of the A-frame when the burden of maximum load is lifted up being made substantially equal to the forward displacement distance of the tip of the jib horizontally displaced forward due to the forward tilting of the crane body when the burden of maximum load is lifted up.

5. A jib crane according to claim 1 characterized in that the luffing rope is mounted to the jib such that it is substantially perpendicular to the load action line of the jib when the burden of maximum load is lifted up.

6. A jib crane as claimed in claim 1, the backward displacement distance of the tip of the jib horizontally displaced backward due to the recurvature of the jib toward the crane body as well as due to the backward displacement of the upper end of the A-frame when the burden of maximum load is lifted up being made substantially equal to the forward displacement distance of the tip of the jib horizontally displaced forward due to the forward tilting of the crane body when the burden of maximum load is lifted up.

7. A jib crane characterized in that a jib is mounted for a luffing motion thereof on a crane body, an A-frame, which guides a lifting rope to a lifting point on the jib, comprising rear and front frames, the rear frame having a sheave for the lifting rope at an upper end thereof and being pivoted at a lower end thereof to a revolving frame, the front frame being pivoted at an upper end thereof to a portion of said rear frame backward of the sheave and being pivoted at a lower end thereof to the revolving frame, cross-sectional areas Af and Ab of the front and rear frames, respectively, being set to satisfy $$\frac{Tf}{Af} > \frac{Tb}{Ab}$$

where, when the burden of maximum load is lifted up, Tf and Tb are tensile forces acting on the front and rear frame of the A-frame, respectively; Af and Ab are the cross-sectional areas of the front and rear frames, respectively, whereby the front frame is elongated to displace backward an upper end of the A-frame when the burden of maximum load is lifted up.

8. A jib crane according to claim 3 characterized in that a backward displacement distance of the tip of the jib horizontally displaced backward due to backward displacement of the upper end of the A-frame through the elongation of the front frame when the burden of maximum load is lifted up is made equal to a forward displacement distance of the tip of the jib horizontally displaced forward due to forward tilting of the front frame when the burden of maximum load is lifted up.

9. A jib crane having a jib mounted to a crane body to be supported for luffing movement thereof by a luffing rope mounted to a longitudinally intermediate portion of the jib, the jib having a truss structure with upper and lower beam members respectively overhanging upward and downward of a load action line that connects a lifting point with a support pin, cross-sectional areas Au and Al of the upper and lower beam members, respectively, being determined depending upon overhang eccentric lengths Eu and El of the upper and lower beam members, respectively, to satisfy $$P \times \frac{El}{H \cdot Au} > P \times \frac{Eu}{H \cdot Al}$$

where, when a burden of a maximum load is lifted up, P is a load applied on the load action line from the tip of the jib; H is a width between upper and lower portions of the jib at a mounting point of the luffing rope; Eu and El are overhang eccentric lengths of the upper and lower beam members at the mounting point of the luffing rope with respect to the load action line, respectively; and Au and Al are cross-sectional areas of the upper and lower beam members, respectively, whereby an upper portion of the jib is recurved toward the crane body when the burden of maximum load is lifted up and that an A-frame, which guides a lifting rope to a lifting point on the jib, comprises rear and front frames, the rear frame having a sheave for the lifting rope at an upper end thereof and being pivoted at a lower end thereof to a revolving frame, the front frame being pivoted at an upper end thereof to a portion of said rear frame backward of the sheave and being pivoted at a lower end thereof to the revolving frame, cross-sectional areas Af and Ab of the front and rear frames, respectively, being set to satisfy $$\frac{Tf}{Af} > \frac{Tb}{Ab}$$

where, when the burden of maximum load is lifted up, Tf and Tb are tensile forces acting on the front and rear frame of the A-frame, respectively; Af and Ab are the cross-sectional areas of the front and rear frames, respectively, whereby the front frame is elongated to displace backward an upper end of the A-frame when the burden of maximum load is lifted up, the backward displacement distance of a tip of the jib horizontally displaced backward due to the recurvature of the jib toward the crane body as well as due to the backward displacement of the upper end of the A-frame when the burden of maximum load is lifted up being made substantially equal to the forward displacement distance of the tip of the job horizontally displaced forward due to the forward tilting of the crane body when the burden of maximum load is lifted up.

* * * * *

UNITED STATES PATENT AND TRADEMARK OFFICE

CERTIFICATE OF CORRECTION

PATENT NO. : 6,508,371 B2
DATED : January 21, 2003
INVENTOR(S) : Isao Miyazawa

It is certified that error appears in the above-identified patent and that said Letters Patent is hereby corrected as shown below:

Title page,
Item [73], Assignee, change "Ishi Kawajima-Harima" to -- Ishikawajima-Harima --.

Column 10,
Line 38, change "claim 3" to -- claim 7 --.

Signed and Sealed this

Twenty-ninth Day of July, 2003

JAMES E. ROGAN
*Director of the United States Patent and Trademark Office*